United States Patent [19]

Straitz, III

[11] 3,995,986

[45] Dec. 7, 1976

[54] FLARE GAS BURNER

[76] Inventor: John F. Straitz, III, c/o Combustion Unlimited Inc., P.O. Box 8856, Elkins Park, Pa. 19117

[22] Filed: Mar. 14, 1975

[21] Appl. No.: 558,283

[52] U.S. Cl. ..... 431/114; 431/4; 431/202

[51] Int. Cl.[2] ..... F23D 13/20

[58] Field of Search ..... 431/4, 114, 202, 278, 431/284, 285; 239/403, 405; 23/277 C

[56] References Cited

UNITED STATES PATENTS

| | | | |
|---|---|---|---|
| 1,510,039 | 9/1924 | Canfield | 239/403 |
| 2,779,399 | 1/1957 | Zink et al. | 431/202 |
| 2,964,121 | 12/1960 | Zink et al. | 431/114 |
| 3,236,279 | 2/1966 | Beyer | 431/284 |
| 3,547,567 | 12/1970 | Turpin | 431/202 |

*Primary Examiner*—Carroll B. Dority, Jr.
*Attorney, Agent, or Firm*—Z. T. Wobensmith, 2nd; Z. T. Wobensmith, III

[57] ABSTRACT

A flare gas burner is described for the smokeless combustion of flare gas at low noise level with the flare gas mixed with steam at the end of the flare burner, the steam being introduced into the flare gas flow and at the center of the vortex of the flow. The apparatus includes vanes to mix the gases and steam and acoustically lined baffling to reduce noise.

9 Claims, 2 Drawing Figures

FLARE GAS BURNER

BACKGROUND OF THE INVENTION

1. Field of the Invention

This invention relates to a flare gas burner of the smokeless type which uses steam and air for smoke suppression and utilizes baffling lined with noise absorbing material to reduce noise.

2. Description of the Prior Art

There have been many flare gas burners developed which use steam to improve combustion and to suppress smoke. Example of such burners are shown in my prior U.S. Pat. No. 3,822,984 and in the patent to Zink et al. U.S. Pat. No. 3,512,911.

In designing flares for smokeless burning there are two primary sources of noise to consider. The first noise source depends on the composition of gas to be burned since the turbulence resulting from mixing the gas with air and steam causes noise which varies depending on how much air and steam are required for smokeless burning. With little mixing the noise level is low, but there is a greater likelihood of smoke due to poor combustion with the result that a compromise is necessary which may not result in the best combustion.

The other primary source of noise is high velocity or jet noise resulting from the flow of steam which is greater when an outer steam ring is used but which is present whenever steam is used for aiding combustion and smoke suppression.

The apparatus heretofore available being a compromise may not perform satisfactorily in areas which are congested and where noise becomes a factor to be considered from the viewpoint of satisfying neighbors and government noise level codes.

The flare gas burner of my invention provides for operation without smoke and at acceptable levels of noise emission.

SUMMARY OF THE INVENTION

In accordance with the invention a flare gas burner is provided which has a stack with flare gas introduced thereinto at the bottom, with fixed vanes at the top of the pipe angularly disposed in a horizontal plane from radial lines through the center of the pipe for vortex discharge of the gas, the stack also having an outer steam ring and a center steam pipe with a flared end above the stack pipe and vanes. The stack pipe and base are provided with acoustical lining disposed to reduce transmitted noise. Igniters and pilots are also provided.

It is the principal object of the invention to provide a flare gas burner that operates at a high combustion efficiency and at acceptable noise levels.

It is a further object of the invention to provide a flare gas burner which is sturdy and simple to construct and requires a minimum of maintenance.

It is a further object of the invention to provide a flare gas burner which can smokelessly and quietly burn flare gasses of varying compositions and at varying flow rates.

Other objects and advantageous features of the invention will be apparent from the description and claims.

The nature and characteristic features of the invention will be more readily understood from the following description taken in connection with the accompanying drawings forming part hereof, in which:

FIG. 1 is a view partly in elevation and partly in vertical section of the flare gas burner in accordance with the invention, and FIG. 2 is a horizontal sectional view enlarged taken approximately on the line 2—2 of FIG. 1.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Figure 1:
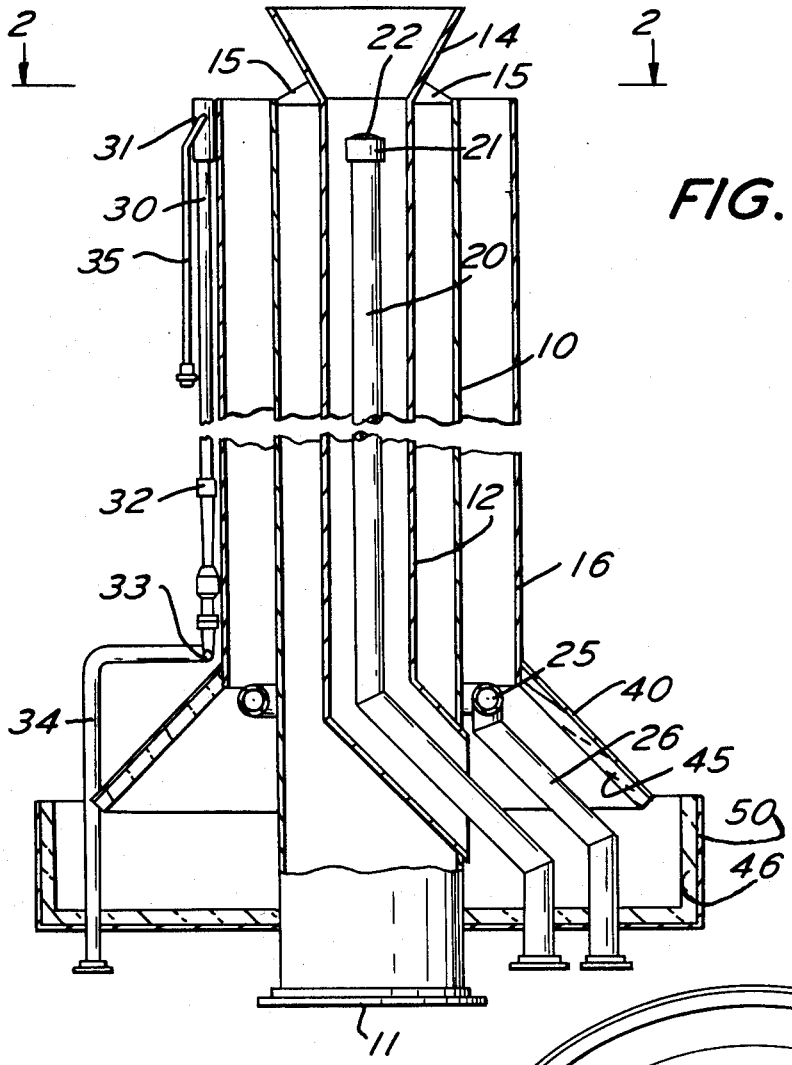
Figure 2:
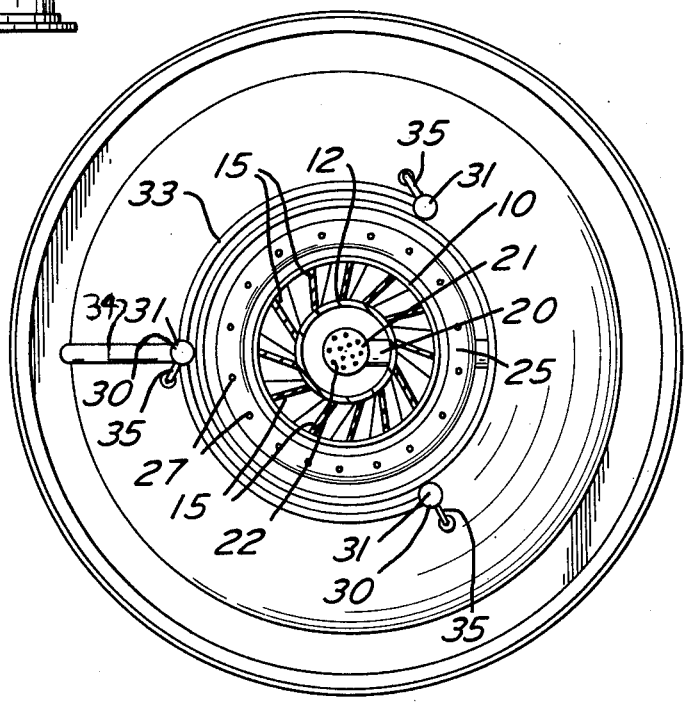

Referring now more particularly to the drawings the flare gas burner of my invention includes a circular stack pipe 10 with a flange connection 11 at its bottom for connection to a source of flare or dump gas (not shown) to be burned. The pipe 10 has a pipe 12 therein of smaller diameter which is provided at the top with an inserted bell shaped or flaring frusto-conical outlet 14.

The outlet 14 is centrally located and connected to the stack pipe 10 by a plurality of flange plates or vanes 15 which are each at an angle, in a horizontal plane to a radial line through the center of pipe 12 and at an angle to a horizontal line passing through the center of pipe 12 so as to impart a swirling motion to the flare gas delivered for burning after discharge from the vanes 15.

A pipe 16 is provided concentric with, and spaced outwardly from the pipe 10 to provide a space for delivery of air for combustion.

The pipe 12 has a center steam pipe 20 therein of smaller diameter and provided with a discharge tip 21 with holes 22 therein for discharge of steam.

The tip 21 is shown as located below the intersection of outlet 14 and pipe 12 but the location may be varied as desired.

Within the pipe 16 and outside pipe 10 a steam ring 25 is provided which has a pipe 26 connected to a source of steam under pressure (not shown) and provided with a plurality of discharge outlets 27 directed upwardly.

A plurality of burner pilots 30 are provided with discharge heads 31 which terminate at the top of pipe 16. The heads 31 are shown as the venturi air inspirating type, and supported by brackets 32 mounted on pipe 16.

The pilots 30 are connected to a ring 33 which can be connected by pipe 34 to a supply of gas under pressure (not shown).

The pilots 30 are also provided with igniter tubes 35 to which a flame can be directed as desired. The pilots 30 can therefore be in continuous or intermittent operation, but preferably are in continuous operation.

The stack pipe 16 at the bottom is provided with a bell shaped housing 40 which is connected thereto and flares outwardly below the pipe 16.

The interior of the housing 40 has a layer of sound absorbing material 45 secured thereto which absorbs the sound caused by air travelling therethrough to the pipe 16 for mixing. The material 45 can be of any suitable heat resistant durable composition, with a ceramic fiber mat having a thickness of the order of 1½ inches and a density of the order of 4 pounds per cubic foot, being one of the preferred materials.

The pipe 10 is surrounded at the bottom with a cup shaped housing 50 which is below the housing 40 and also lined with a layer of sound absorbing material 46 which can be the same as that of the layer 45.

In use, combustible gas to be burned is delivered through pipe 10 to the plates 15 which impart a swirling motion. The swirling gas is directed outwardly by the cone or outlet 14.

Air for combustion induced upwardly through the pipe 12 by the steam discharge tip 21 also spreads as it is discharged from the cone or outlet 14 for contact with the combustible gas.

Air for combustion induced upwardly in the space between the pipes 10 and 16 by the discharge of steam through the openings 27 comes into intimate contact with and mixes with the combustible gas from the vanes 15 for burning.

The swirling column of combustible gas is thus between inner and outer streams of steam and air with continuous mixing.

The pilots 31 are effective for ignition of the flare gas air-steam mixture which burns in an ascending swirling column, air from the surrounding atmosphere also being drawn into the column and aiding in the completion of combustion.

The middle frequency combustion noise from the burning gases, and which is dependent on the composition of the gas, the turbulence in the mixing and the burning is absorbed by the linings 45 and 46.

The higher frequency or jet noise from the use of the steam is directional and hence tends to be directed upwardly but downward noise is absorbed by the lining 46.

Combustion because of the effective mixing of air and waste gas together with the admixture of the steam is smokeless, and by reason of the provisions for noise suppression will be quiet.

It will thus be seen that structure has been provided with which the objects of the invention are achieved.

I claim:

1. A flare gas burner for combustible waste gas comprising a vertical stack having a plurality of concentric pipes, one of said pipes being an outer pipe, one of said pipes being an intermediate pipe and another of said pipes being an inner pipe.

said inner pipe having a steam discharge member therein for inducing combustion supporting air in said inner pipe, the space between said inner pipe and said intermediate pipe providing for the delivery of said combustible waste gas for combustion, members for imparting a rotary and diverging motion to said combustible gas upon discharge from said space between said inner and intermediate pipes, and the space between said outer pipe and said intermediate pipe having a steam discharge member therein for inducing combustion supporting air therein for delivery into contact with said discharging combustible gas.

2. A flare gas burner for combustible waste gas as defined in claim 1 in which means is provided for reducing transmission of noise resulting from the induction of the air into said air delivery spaces, said means comprising sound absorbing members contiquous to the induced air inlets to said spaces.

3. A flare gas burner for combustible waste gas as defined in claim 1 in which means is provided for reducing transmission of noise resulting from the induction of air into said air delivery spaces, and said means comprises a lower sound absorbing member extending upwardly from below the inlets to said spaces.

4. A flare gas burner as defined in claim 3 in which said means also comprises an upper sound absorbing member extending downwardly below the upper margin of the lower sound absorbing member.

5. A flare gas burner as defined in claim 2 in which said means comprises an upper sound absorbing member extending downwardly below the lower margin of at least one of said air delivery spaces.

6. A flare gas burner as defined in claim 5 in which said upper sound absorbing member flares outwardly toward its lower margin.

7. A flare gas burner for combustible gas as defined in claim 4 in which said upper and said lower sound absorbing members are disposed in vertically overlapped relation to reduce outward noise transmission.

8. A flare gas burner as defined in claim 2 in which an air inlet is provided for said pipes, said air inlet has a flaring member in surrounding relation thereto, and said flaring member has one of said sound absorbing members carried thereby,

9. A flare gas burner as defined in claim 8 in which a horizontal member is provided contiguous to said flaring member, and another of said sound absorbing members is carried thereby.

* * * * *